United States Patent [19]

Alger

[11] Patent Number: 4,651,527

[45] Date of Patent: Mar. 24, 1987

[54] PROCESS AND APPARATUS FOR REDUCING THE LOSS OF HYDROGEN FROM STIRLING ENGINES

[76] Inventor: Donald L. Alger, 3419 W. 144th St., Cleveland, Ohio 44111

[21] Appl. No.: 866,486

[22] Filed: May 23, 1986

[51] Int. Cl.[4] ..... F02G 1/04

[52] U.S. Cl. ..... 60/517

[58] Field of Search ..... 60/517, 521

[56] References Cited

U.S. PATENT DOCUMENTS

| | | | |
|---|---|---|---|
| 3,164,493 | 1/1965 | Lindberg | 148/6.3 |
| 3,732,690 | 5/1973 | Meijer | 60/39.46 |
| 4,197,707 | 4/1980 | Asano | 60/517 |
| 4,312,641 | 1/1982 | Verrando et al. | 55/33 |
| 4,335,884 | 6/1982 | Darche | 277/3 |

*Primary Examiner*—Allen M. Ostrager

*Attorney, Agent, or Firm*—Fay, Sharpe, Fagan, Minnich & McKee

[57] ABSTRACT

A permeation barrier is maintained on inner surfaces of a Stirling engine, particularly the heat tubes, by maintaining a preselected concentration of dopant gas in the working gas, e.g. hydrogen. A dopant gas (10) is adsorbed on a sorbent (1) in a dopant cartridge or enclosure (2). The amount of gas adsorbed, the quantity of sorbent, and the permeability of a permeable window (3) are selected such that a preselected partial pressure of the dopant is maintained in the hydrogen. In a diffusion cell (FIGS. 1 and 2) an equilibrium partial pressure of the dopant gas is maintained by diffusion through the porous window. In a flow-through cell (FIGS. 3–5) the hydrogen or working gas is circulated through the sorbent. A fraction of the adsorbtion sites on the sorbent may be left open to adsorb excess water vapor from the hydrogen. In a trap cell (FIGS. 9 and 10) water vapor is removed from the working gas as the working gas is pumped by a compressor into a high pressure storage reservoir (59). An appropriate partial pressure of water vapor dopant is reintroduced into the hydrogen as the hydrogen passes from the high pressure reservoir through the trap cell back into the working volume of the Stirling engine. To facilitate handling of the activated sorbent cells without exposing the sorbent to contaminants, a collapsible barrier (29, 42) is provided for automatically isolating the sorbent when the cell is exposed to the atmosphere.

20 Claims, 10 Drawing Figures

5

PROCESS AND APPARATUS FOR REDUCING THE LOSS OF HYDROGEN FROM STIRLING ENGINES

BACKGROUND OF THE INVENTION

The present invention relates to the art of gas permeation reduction. It finds particular application in conjunction with reducing hydrogen loss in Stirling engines by establishing and maintaining a hydrogen permeation barrier on the inner surface of the engine heat tubes and will be described with particular reference thereto. However, it is to be appreciated that the present invention will have other applications particularly where hydrogen or other highly permeable gases function as the working fluid.

Stirling engines achieve the greatest efficiency with a low molecular weight gas for the working medium, e.g. hydrogen or helium. The relative rarity and high cost of helium gas render its use impractical for commercial engines in which a large volume of working medium or gas would be required. Hydrogen, which is both more abundant and lower in molecular weight than helium, readily permeates the metal alloys and other materials of which Stirling engines are commonly constructed. The loss of hydrogen by permeation through these metal alloys at the relative high temperature and pressures of a Stirling engine are generally considered to be unacceptably high.

A relatively small partial pressure of carbon dioxide, carbon monoxide, or water vapor as a dopant has been found to be effective in reducing the loss of hydrogen by permeation. However, the temperature and pressure variations within a Stirling engine are sufficiently great that the water vapor tends to condense in the cooler regions of the engine. The condensed water vapor causes severe mechanical and corrosion problems. During the engine cycle, the carbon dioxide and monoxide dissociate, freeing oxygen which combines with the hydrogen to form additional water vapor. The increasing concentration of water vapor, again, condenses in regions of lower temperature or higher pressure.

Commonly, carbon monoxide and carbon dioxide are effective in reducing hydrogen permeation over a partial pressure range of 0.1 to 1.0%. To avoid condensation problems, the water vapor must be present in partial pressures that are sufficiently low that condensation is avoided. The exact partial pressure, of course, varies with the operating temperature and pressure of the engine. However, partial pressures which are lower than 0.1% are normally required.

Other approaches for reducing hydrogen loss are illustrated in U.S. Pat. No. 4,197,707 issued Apr. 15, 1980 to Kenji Asano, which has a recovery system for recapturing lost hydrogen which has escaped from the system. U.S. Pat. No. 4,335,884 issued June 22, 1982 to Michael Darche limits hydrogen loss between the pistons and cylinder walls through the use of flexible or rolling diaphragms. Both of these techniques, however, are limited in their ability to stop hydrogen loss.

In accordance with the present invention, a method and apparatus is provided for accurately maintaining dopant levels in the working fluid of Stirling engines and the like.

SUMMARY OF THE INVENTION

In accordance with one aspect of the present invention, a method is provided for maintaining a selected dopant gas concentration in the working gas of a Stirling engine. A selected dopant is adsorbed on an activated sorbent. The dopant adsorbed sorbent is connected in gaseous communication with the working gas of the Stirling engine. The dopant adsorbed sorbent and its interconnection with the Stirling engine are configured such that a preselected equilibrium partial pressure is maintained between the dopant and working gases.

In accordance with another aspect of the present invention, a Stirling engine is combined with a source of dopant gas. The dopant gas source includes a hermetic enclosure which isolates an interior thereof from the atmosphere. An activated sorbent with a dopant adsorbed thereon is disposed within the hermetic enclosure. A gas passing means operatively connects the hermetic enclosure interior and an interior of the Stirling engine such that the dopant and working gases flow therebetween to establish a preselected partial pressure equilibrium.

In accordance with more limited aspects of the present invention, the working gas is hydrogen and the dopant gas is selected from the group of carbon monoxide, carbon dioxide, and water vapor. The sorbent may be any material which appropriately adsorbs the selected dopant, such as a molecular sieve, activated alumina, activated carbon, activated charcoal, saliceous sorbents, zeolites, other carbons, and organic materials including crosslinked polystyrene, porous resin, phenolic, acrylic ester, and cellulose.

In accordance with another more limited aspect of the present invention, the sorbent enclosure is configured as a diffusion cell in which a permeable membrane is disposed between the sorbent and the working gas of the Stirling engine. In another aspect, the enclosure is configured as a flow-through cell in which the working gas flows through the sorbent in the enclosure from an area of high pressure on one side of the enclosure to an area of lower pressure on the other side of the enclosure. In accordance with yet another more limited aspect of the invention, the sorbent removes excess water vapor. This last aspect is particularly advantageous in adding and removing water vapor to working gas as it is discharged from and returned to a high pressure storage reservoir.

A primary advantage of the present invention resides in reduced hydrogen loss from Stirling engines.

Another advantage of the present invention, is that it provides for the accurate control of partial pressures of dopants within a working gas.

Still further advantages of the present invention will become apparent to those of ordinary skill in the art upon reading and understanding the following detailed description of the preferred embodiments.

BRIEF DESCRIPTION OF THE DRAWINGS

The invention may take form in various steps and arrangements of steps and in various elements and arrangements of elements. The figures are only for purposes of illustrating preferred embodiments and are not to be construed as limiting the invention. Wherein the figures show.

DETAILED DESCRIPTION OF THE PREFERRED EMBODIMENT

Figure 1:
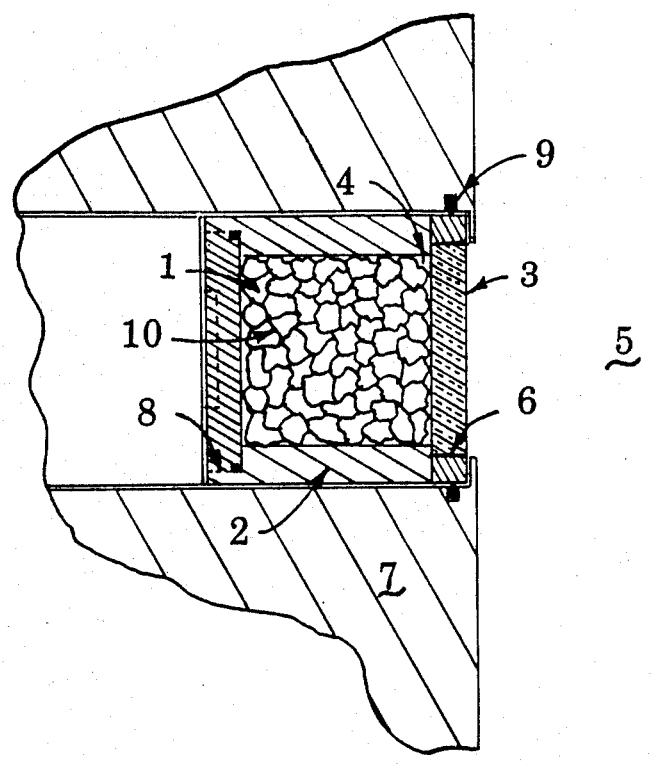
FIG. 1 illustrates a diffusion cell mounted inside a Stirling engine in accordance with the present invention.

With reference to FIG. 1, an activated sorbent 1 is contained inside a cell container or hermetic enclosure 2 which separates the activated sorbent from the atmosphere. A gas flow means connects the enclosure interior 4 with an engine volume 5. In the preferred embodiment, the gas flow means includes a sintered metal element or window 3 which permits dopant and working gases to pass therethrough. The window 3 is sealed to the enclosure 2 such as by a weld 6 to seal the sorbent 1 in the cells. The enclosure 2 is attached within a Stirling engine 7 in such a manner that good thermal contact is maintained therebetween. Optionally, a threaded cap and seal 8 may be provided to facilitate loading the cell with the sorbent. An O-ring 9 or other appropriate seal prevents the loss of working gas around the cell.

The sorbent 1 has a dopant 10 adsorbed thereon. In one preferred embodiment, the adsorbed dopant is carbon dioxide. More specifically, a sorbent selected from the sorbents listed in Table 1 below is loaded into the enclosure. Adsorbed atmospheric air components are removed from the sorbent, commonly with a combination of heat and vacuum to activate the sorbent. Thereafter, substantially pure carbon dioxide is passed into the enclosure such that the carbon dioxide is adsorbed on the sorbent until the sorbent is saturated. The cell is then sealed from the atmosphere with an appropriate seal across the window to prevent any exchange of the carbon dioxide and atmospheric gases prior to loading of the cell in the Stirling engine. Optionally, interstices between particles of the adsorbent may be filled with hydrogen.

TABLE 1

| Sorbent | Trade Name | Surface Area, m/gm |
|---|---|---|
| SILICEOUS SORBENTS | | |
| Aluminosilicates | Molecular sieves, Linda 3A, 4A, 5A, 10X, 13X, AW-300, AW-500, etc. | 600–800 |
| Silica gel | Davison Silica gel, Cecagel, Sorbsil, etc. | 300–800<br>650–900 |
| Acid treated clay | Clarsil | 200–300 |
| Magnesia-silica gel | Florsil | 300 |
| Fuller's earth | Cecacite, Clarisil PSC-G | 120–250 |
| Diatomaceous earth | Chromosorb P | 4 |
| | Chromosorb W | 1 |
| | Chromosorb G | .5 |
| | Chromosorb A | 2.7 |
| NATURAL ZEOLITES | | |
| Analcite | | 700–800 All |
| Brewsterite | | |
| Cancrinite | | |
| Chabazite | | |
| Edingtonite | | |
| Epistilibite | | |
| Erionite | | |
| Faujasite | | |
| Gismondite | | |
| Gmelinite | | |
| Harmotome | | |
| Heulanite | | |
| Laumonite | | |
| Levynite | | |
| Metascolecite | | |
| Metathomsonite | | |
| Mesolite | | |
| Mordenite | | |
| Natrolite | | |
| Phillipsite | | |
| Scolecite | | |
| Staurite | | |
| Stilbite | | |
| Thomsonite | | |
| Zoisite | | |
| ALUMINAS | | |
| Active Alumina | Alcoa F-1, Reynolds R-2101, Kaiser KA 201, Harshaw AL-0104T | 90–400 |
| Co—C12 impregnated | Alcoa F-6 | 200 |
| Catalytic alumina | Pechiney | 300 |
| Activated bauxite | Florite | |
| Chromatographic alumina | Alcoa F-20 | 225 |
| CARBONS | | |
| Shell-based | Cochranex FCB | 800–1100 |
| | Picactif T.A. | 1000–1600 |
| | Acticarbone NC | 1200–1500 |
| | Barnebey-Chaney AC | 800–1100 |
| | Girdler 32E | 800–900 |
| Wood based | Acticarbone AC | 750–1400 |
| | Darco KB | 600–1200 |
| | Supersorbon W | 1400 |
| | Carboraffin | 1000–1500 |
| | Brilonit | 750–900 |
| | Cochranex FCN-1 | 600–1000 |
| | Picotif C.O. | 800–1200 |
| | Picactif CM | 600–1200 |
| Coal based | Darco granular | 500–1200 |
| | Cochranex FCP-1 | 800–1000 |
| | Pittsburgh BPL | 1000–1400 |
| | Barnebey-Cheney MN | 110 |
| | Acticarbone | 850–1300 |
| | Contarbon | 1300–1500 |
| | Darco BC | 600–700 |
| Peat based | Norit | 500–1600 |
| | Supersorbon | 1300–1400 |
| | Acticarbone | 700–900 |
| Petroleum based | Columbia | 800–1100 |
| ORGANIC MATERIALS | | |
| Crosslinked polystyrene | Chromosorb 101, 103 | 15–35 |
| Porous resin | Asmit 224 | 3 |
| Polystyrene (cross-linked) | Amberlite XAD-2 | 330 |
| | Amberlite XAD-4 | 750 |
| | Chromosorb 102 | 300–400 |
| Phenolic | Duolite S-30 | |
| Acrylic ester | Amberlite XAD-7 | 450 |
| | Amberlite XAD-8 | 110 |

TABLE 1-continued

| Sorbent | Trade Name | Surface Area, m/gm |
|---|---|---|
| Cellulose | Whatman CC31 | 30000 |

The Stirling engine working gas volume 5 is pressurized with pure hydrogen which has been doped with carbon dioxide gas. The hydrogen is typically at a pressure of about 150 bar and may typically range over the course of the cycle between 135 and 165 bar. The carbon dioxide gas dopant is preferably in the range of 0.1 to 1.0%.

The sorbent, carbon dioxide adsorption charge, the volume of the cell, and the configuration of the porous window are selected such that the selected 0.1 to 1.0% concentration of carbon dioxide is maintained as the equilibrium partial pressure in the Stirling engine at its operating temperature and pressure. As some of the carbon dioxide gas reacts with the interior surfaces of the Stirling engine to form a hydrogen permeation barrier, additional carbon dioxide is released from the sorbent into the engine such that the partial pressure is maintained constant. If the hydrogen is doped with carbon dioxide before the diffusion cell is inserted and if the sorbent is fully saturated with carbon dioxide gas, a relatively small cell volume may be possible.

As the engine is operated, the molecules of carbon dioxide gas are slowly converted in the Stirling engine, particularly in the heater tubes, to water vapor molecules. Some of the water vapor molecules enter the cell interior 4. The selectivity of the molecular sieve sorbent for particular species is such that a water vapor molecule will displace an adsorbed carbon dioxide molecule and become adsorbed in its place. In this manner, excess water vapor from the Stirling engine is exchanged for additional carbon dioxide.

Optionally, additional activated adsorbent can be provided for adsorbing methane molecules which may form in the Stirling engine. For lower concentrations of carbon dioxide, some of the sorbent may be activated but have no carbon dioxide adsorbed thereon. This enables water vapor and methane to be adsorbed without displacing like numbers of carbon dioxide molecules.

As yet another option, the sorbent may be loaded with carbon monoxide dopant. Typically, larger volumes of sorbent are required to supply required concentrations of carbon monoxide. Because only a fraction of the adsorption sites of the sorbent are typically loaded with carbon monoxide, a large number of sites are available for the adsorption of water vapor and methane products.

As yet another option, water may be substituted for carbon dioxide as the adsorbed dopant. Water vapor is an effective dopant source of oxygen for metal oxide formation on the inner walls of the Stirling engine heater tubes. When water vapor is used as the dopant, no undesirable gaseous byproducts are formed. The cell volume can be relatively small as compared to a carbon monoxide source because no adsorbent sites need be reserved for chemical reaction byproducts.

In operation, the activated sorbent 1 is contained inside the enclosure 2. The Stirling engine working gas volume 5 is pressurized with pure hydrogen which has been doped with water vapor to a preselected dopant concentration, typically lower than 1000 ppm. The cell is typically positioned within the Stirling engine in such a position that it is heated to the range of 200°–400° F. Increasing the temperature increases the partial pressure of the water vapor in the working gas and decreasing the temperature decreases the concentration of water vapor. The regeneration portion of the Stirling engine typically extends between the warmer and cooler portions of the engine. By interconnecting the cell in the appropriate position along the regenerator wall, the heating temperature of the diffusion cell can be selected. When the engine is shut down and cools, the diffusion cell also cools. At the lower temperatures, the sorbent increases its adsorption of water vapor, removing potentially corrosive water vapor and water condensation from the Stirling engine. At 70° F., the partial pressure of water vapor is typically in the range of 0.0003 psi.

The concentration of water vapor is selected to be below the saturation pressure of water at the working temperature and pressure of the Stirling engine. At a working temperature of 50° C. and a working pressure of 150 bar, a water vapor concentration of 822 ppm represents the saturation level. Accordingly, the sorbent is loaded and its temperature is maintained such that the equilibrium water vapor pressure in the cell volume 4 and the engine volume 5 is less than the saturation pressure in the coldest region of the engine, commonly the engine cooler.

Figure 2:
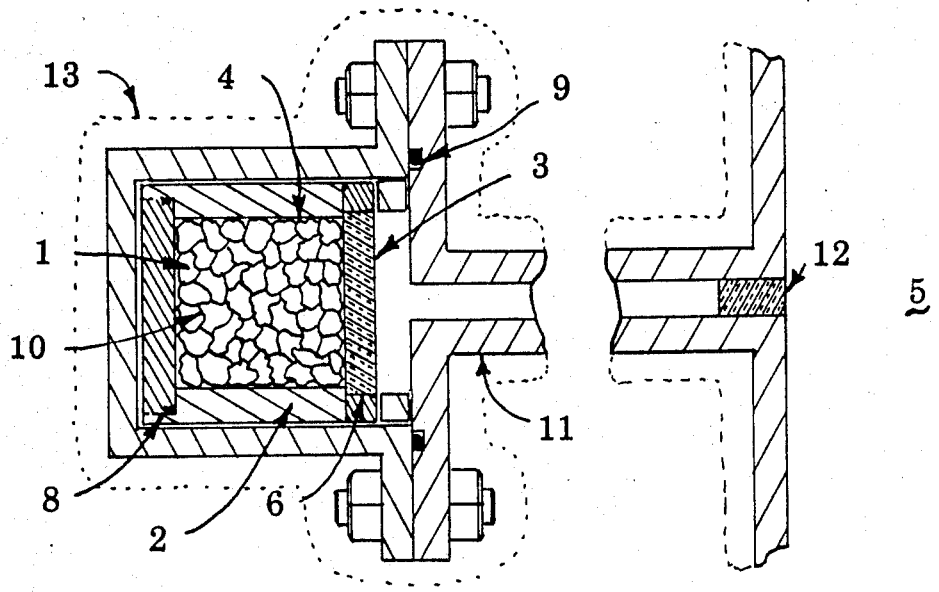
FIG. 2 illustrates a diffusion cell mounted externally to a Stirling engine.

With reference to FIG. 2, the diffusion cell may also be mounted exterior to the Stirling engine. The gas passing means further includes an extender tube 11 which provides a fluid passage between the working volume of the engine and the diffusion cell. A flow restrictor 12 and the relatively long narrow dimension of the extender tube 11 limit pressure gradient changes at the diffusion cell. This enables the diffusion cell to be connected with a portion of the working volume of the engine in which the pressure gradients vary by providing a relatively minimal pressure variation at the diffusion cell. The flow restrictor 12 may perform the flow limiting function rather than porous window 3. The porous window then functions merely as a screen to retain the sorbent in the cell and may be of a thinner and less restrictive construction.

Optionally, a heater 13 may be provided for controlling the temperature of the diffusion cell. The heater 13 may control the partial pressure of the selected dopant as described above. As yet another option, the diffusion cell may be charged with dopant after the interconnection with the engine. The heater is used to drive off any adsorbed molecules while the working volume of the Stirling engine is evacuated. After the sorbent has been activated, the dopant may be supplied through the Stirling engine, generally mixed with hydrogen gas.

Figure 3:
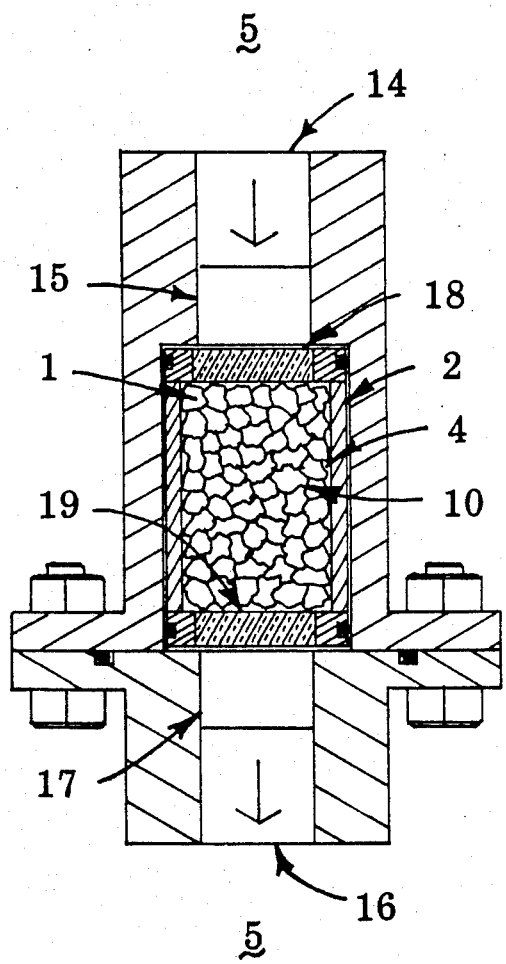
FIG. 3 illustrates a flow-through cell installed inside a Stirling engine.

With reference to FIG. 3, the dopant concentration in the working gas may be maintained uniformly by passing the working gas through the dopant cell. Such a cell is commonly denoted as a flow-through type cell. The flow-through type cell is installed in the working space of the engine such that the pressure gradients within the engine pump the working fluid through the cell. The enclosure 2 is configured as may be appropriate to use available non-working gas volume of the engine with a minimal, if any, increase in the overall engine volume. The gas passing means includes a first or inlet check valve 14 which opens at a relatively high pressure to fill manifold 15 with the working gas, e.g. at a pressure of 165 bar. When the working pressure drops to a relatively low pressure, e.g. about 135 bar, a second or outlet check valve 16 opens to drop an outlet manifold 17 toward the lower pressure. The pressure differential between manifolds 15 and 17 urges the working fluid through the flow-through cell.

The flow-through cell is constructed with two windows for flow restrictors. A first or inlet flow restrictor and filter 18 allows the working fluid to pass into the interior 4 of the cell. A second or outlet flow restrictor and filter 19 permits the working gas with any adsorbed dopant to pass from the flow-through cell. Preferably, the first and second filter and flow restrictors are constructed with a porous metal with about an 0.5 micron pore size. The thickness and frontal area of the flow restrictor and filters is selected to prevent sorbent particles from leaving the cell and to limit the rate at which hydrogen passes therethrough. Optionally, other flow restrictors, such as capillaries, parallel capillaries, porous metal, and the like may utilized. The flow restrictors are selected to provide the minimum hydrogen flow through the sorbent which is necessary to maintain the desired dopant level in the engine volume. Because flow through the cell drains pressure waves from the engine, hence, costs energy, passing more than the mimimum necessary flow is undesirable. Accordingly, the exact physical construction of the gas passing means, particularly the flow restrictors, will vary with engine size and configuration.

Figure 4:
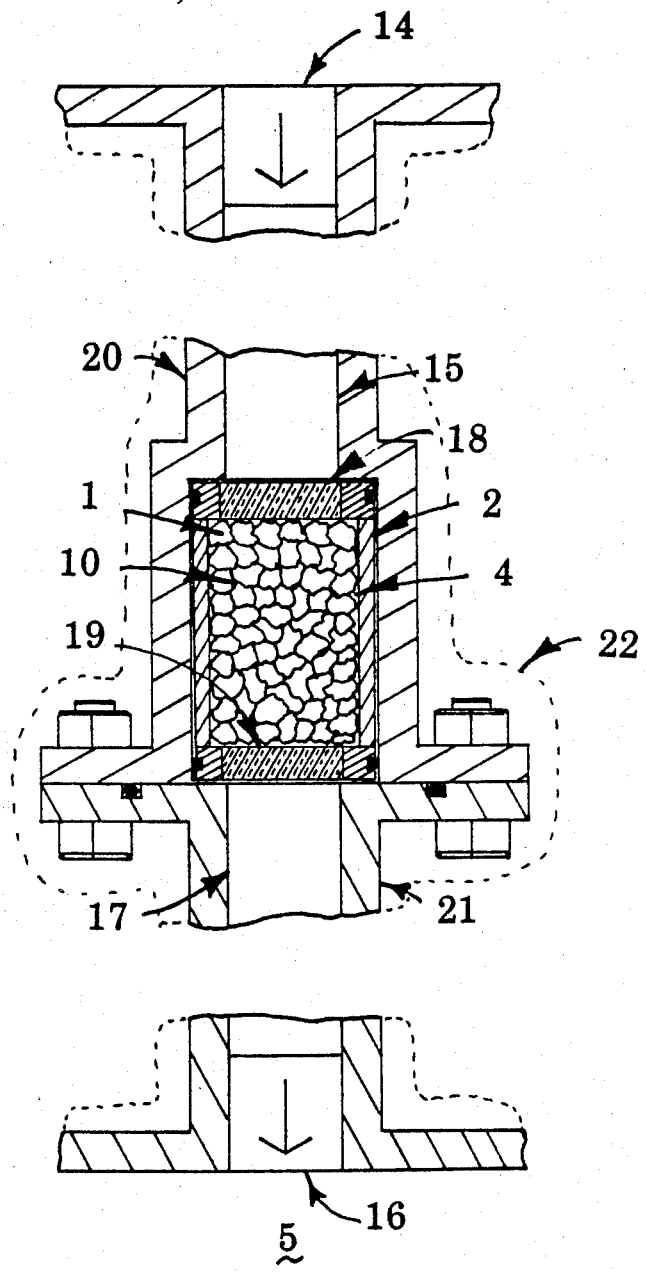
FIG. 4 illustrates a flow-through cell configured to be mounted externally of the engine.

With reference to FIG. 4, a flow-through cell may also be mounted external to the engine. With the external mount, the gas passing means includes an inlet tube 20 and an outlet tube 21 which extend between the respective check valves and manifolds. The inlet and outlet check valves 14 and 16 are positioned close to the engine volume 5. In a free-piston Stirling engine, for example, the cell may be coupled to a gas spring volume, preferably the larger piston gas spring. Optionally, a heater 22 surrounds the cell and gas passing means to control the temperature thereof. Preferably, the heater draws waste heat from the combuster, preheater, or other high temperature components of the engine.

Figure 5:
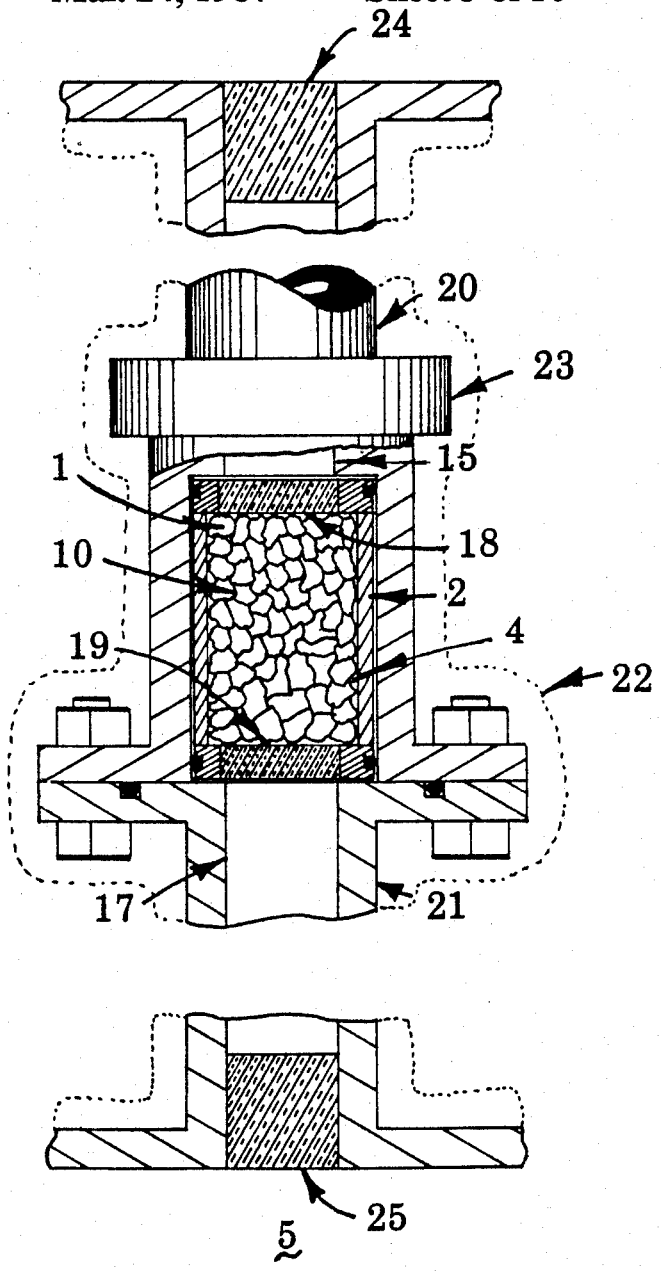
FIG. 5 illustrates a flow-through cell which incorporates a blower for causing a pressure differential thereacross in accordance with the present invention.

With reference to FIG. 5, the pressure gradient across the flow through cell may be created by an auxilliary pressure gradient creating means, such as a mechanical blower 23. The blower includes a fan and an auxiliary engine, such as an electrical motor. The continuous operation of the blower maintains an appropriate pressure gradient across the flow-through cell without relying on pressure gradients from the Stirling engine. Accordingly, check valves are no longer necessary. Rather, an inlet flow restrictor 24 and an outlet flow restrictor 25 provide flow resistance and isolate the cell from the pressure gradients of the engine.

Figure 6:
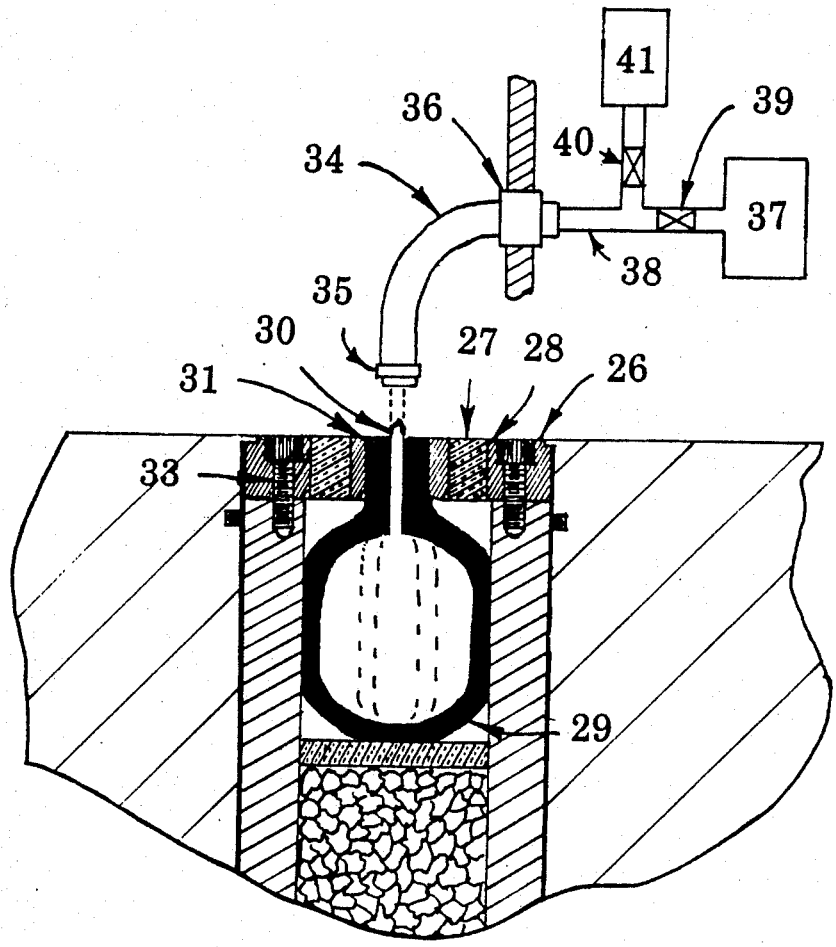
FIGS. 6, 7, and 8 illustrate self-sealing cells which may be of either the diffusion or flow-through type for sealing the sorbent from the atmosphere when the cell is separated or disconnected from the engine.
Figure 7:
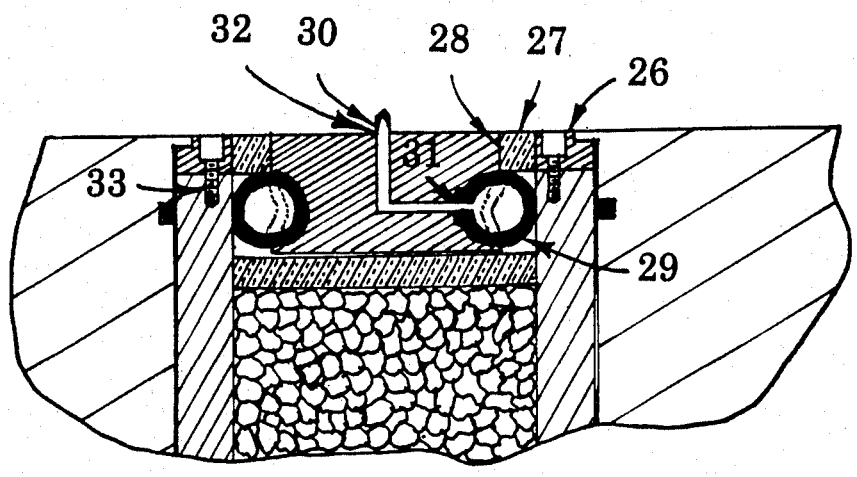

With reference to FIGS. 6 and 7, the sorbent readily adsorbs gaseous molecules that are present in the air. As described above, the sorbent has a preference for certain molecules which displace other adsorbed molecules. Accordingly, if either the diffusion or flow-through cells are left exposed to the air, contaminants may be adsorbed on the sorbent. One solution described above is to charge the cells before they are connected with the Stirling engine. Such charging is conveniently done inside of a glove box, i.e. a closed containment with a controllable pressure and inert gas environment. To facilitate charging of the cells, an automatic cell enclosure means is provided.

In the embodiment of FIG. 6, the automatic enclosure means includes a base cover 26 which has one or more porous windows 27 which are sealed to the cover by weld 28 or the like. An expandable elastomeric sealing element 29 is connected by a fill tube 30 to the exterior of the closure cover 26. The expandable element 29 is bonded to the fill tube and the cover by an elastomer-to-metal adhesive 31.

Prior to connecting the cell to a Stirling engine, the cell is placed inside the glove box for charging with dopant. Screws 33 and cover 26 are removed and the cell is put inside the glove box. The box is then purged with inert gas until all air is removed from the box and open cell. After filling the cell with the activated sorbent, the closure cover 26 is sealed thereto with screws 33. A vacuum hose 34 is clamped with a clamp 35 to the fill tube 30. The vacuum hose extends through a feedthrough 36 in the side wall of the glove box. A vacuum pump 37 is connected by a second vacuum tube 38 and a vacuum valve 39 with the first vacuum tube 34. A second vacuum valve 40 connects the vacuum tube 34 with a source 41 of inert gas. With the inert gas valve 40 closed and the vacuum valve 39 open, the vacuum pump is operated until the expandable element 29 collapses sufficiently that gas flows therepast to the interior of the cell. Vacuum valve 39 is closed and the appropriate dopant is injected into the glove box until the selected partial pressure of dopant has been reached. The selected partial pressure is maintained as the dopant is adsorbed on the sorbent 1, generally a period of five to thirty minutes. The valve 40 is then opened and compressed inert gas is fed into the collapsible element 29 until a pressure sufficient to seal the collapsible element against the walls is attained, generally about one to two atmospheres. The fill tube 30 is then permanently sealed closed, trapping the inert gas in the collapsible sealing element 29. The cell may then be removed from the glove box and attached to the Stirling engine.

If the cell is a flow-through cell, a like sealing means is provided at both ends. If the cell is a diffusion cell, only a single automatic sealing means need be provided. The pressure in the collapsible element is lower than the normal operating pressure of the Stirling engine. In this manner, once the Stirling engine is up to operating pressure, the collapsible element 29 collapses sufficiently to allow gas to flow therepast.

With reference to FIG. 7, the collapsible element 29 may be configured as an annular ring for selectively sealing and passing gas between the flow restrictors 27 and the interior of the cell. In the embodiment of FIG. 7, the fill tube 30 is sealed to the cover 26 by appropriate sealing means such as a weld 32. Alternately, other collapsible element arrangements may be provided.

Figure 8:
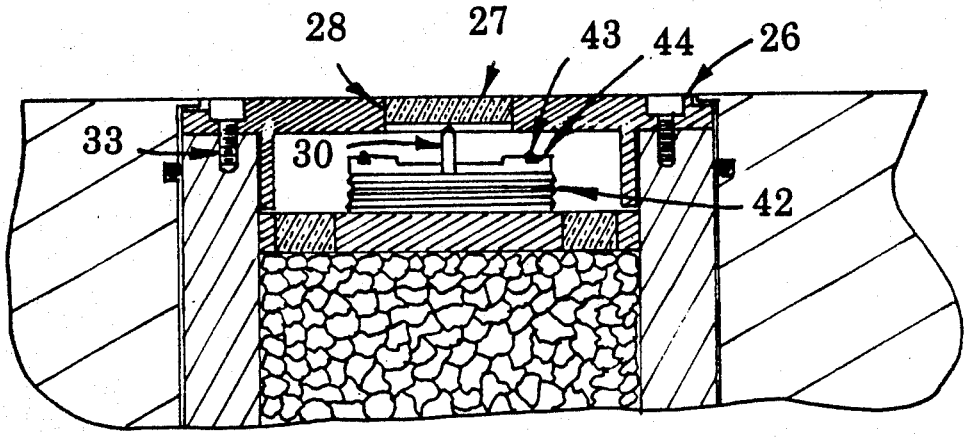

With reference to FIG. 8, the collapsible element may be a metal bellows 42 rather than an elastomeric bladder. An O-ring 43 which is held in an O-ring groove 44 improves the gas tight seal between the expandable bellows and the cover 26. The interior of the bellows is again charged with an inert gas having sufficient pressure relative to atmospheric pressure to hold the bellows in the expanded state yet sufficiently low pressure relative to the operating pressure of a Stirling engine that the Stirling engine pressures compress the metal bellows allowing the exchange and flow of gas therepast. Various other loading and sealing arrangements may also be utilized, provided the completed cell contains sorbent which is free of contaminants and which is loaded with sufficient dopant to provide the selected dopant partial pressure in the engine.

Some Stirling engines achieve power control by varying the pressure of the hydrogen working gas. The engine is connected to a high pressure hydrogen reservoir which is maintained higher than the mean engine pressure. To provide a sudden increase in engine power, hydrogen or other working gas is quickly fed into the engine from the reservoir. To decrease the power supplied, the hydrogen is pumped from the engine back to the supply reservoir. This large increase and decrease in the pressure of the working gas is typically accompanied by large changes in the temperature of the stored working gas. This tends to cause water vapor gas to condense in the high pressure reservoir.

Figure 9:
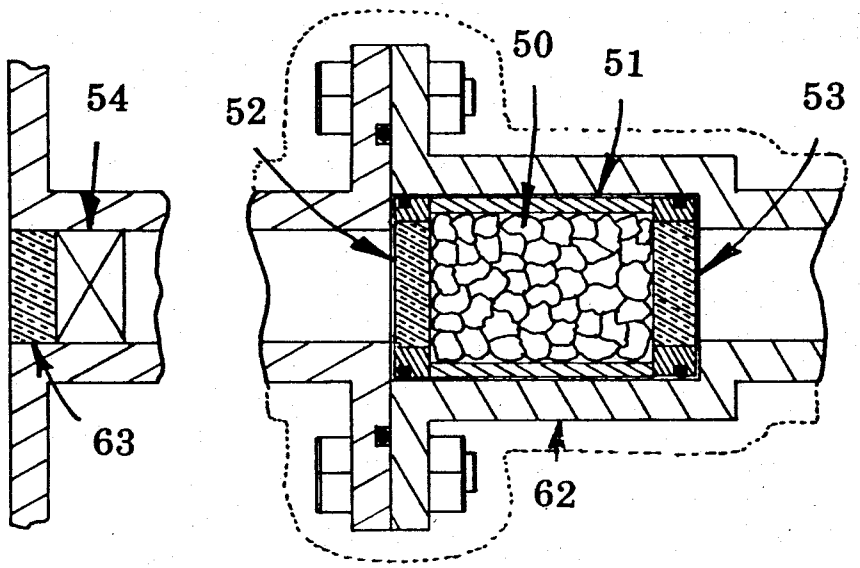
FIG. 9 illustrates a trap cell in accordance with the present invention which is configured for external mounting.
Figure 10:
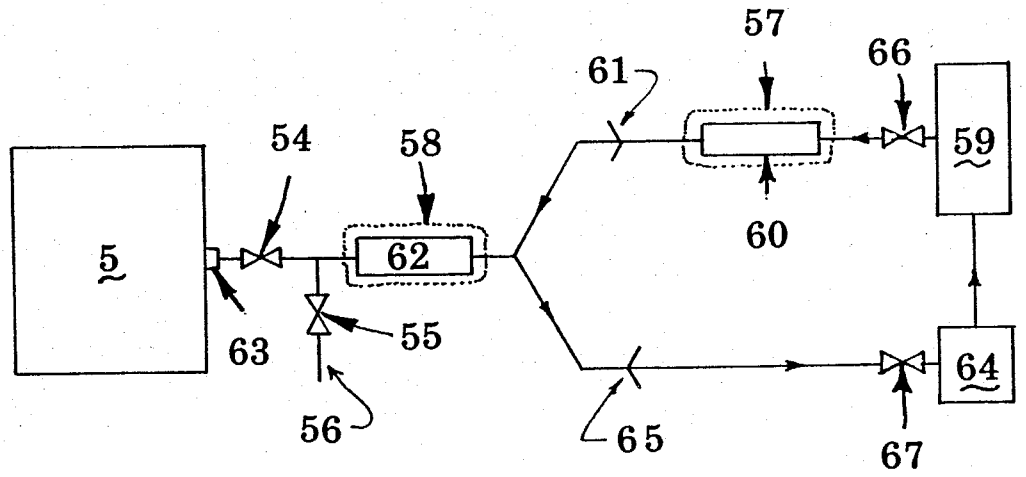
FIG. 10 illustrates a Stirling engine arrangement including a Stirling engine, a reservoir of high pressure hydrogen, and a trap cell in accordance with FIG. 9.

With reference to FIG. 9, water vapor is removed by trap cell 62 as the water vapor doped hydrogen flows from engine volume 5 to the high pressure reservoir. Water vapor is returned to the hydrogen as the gas is returned from the reservoir to engine volume 5. A sorbent 50 with an affinity for water vapor is located inside an enclosure 51 between porous windows 52 and 53. The sorbent 50 may be activated before attachment to the Stirling engine and the opening of control valve 54 or may be activated during engine charging. With particular reference to FIG. 10, the trap cell can be activated prior to engine operation by opening a vent valve 55 which connects the trap cell with a vent 56 while applying heat to the trap cell with heaters 57 and 58. The vent valve and the heaters are adjusted such that when valve 66 is opened, hydrogen flows from a high pressure hydrogen reservoir 59 through a heat exchanger 60, a check valve 61, the trap cell 62, the vent valve 55, and out of the vent 56. The sorbent is typically heated to the range of 200°-300° C. to desorb contaminating gases therefrom. After the cell activation has been completed, generally 5-30 minutes, vent valve 55 and reservoir valve 66 are closed and the heaters 57 and 58 turned off.

Once the trap cell 62 has been activated, the engine volume 5 may be purged in preparation for pressurizing and loading of either diffusion or flow-through cells with water vapor. The engine volume 5 is pressurized with hydrogen by opening the control valves 54 amd 66 until hydrogen from the reservoir 59 has pressurized the engine through a flow restrictor 63 to the desired operating point. The flow restrictor 63 functions to isolate the hydrogen fill lines from pressure waves in the engine. After closing the control valves 54 and 66, water vapor is injected to load the cells, whether diffusion or flow-through type, associated with the engine.

To reduce the operating power level of the engine, valves 54 and 67 are opened and a compressor 64 pumps the working gas into the reservoir 59. More specifically, hydrogen doped with water vapor or other condensable dopant is pulled through the trap cell 62 and a check valve 65. The water vapor is adsorbed from the working gas such that only dry hydrogen is pumped into the reservoir 59. When more power is required, heater 57 is activated and control valves 54 and 66 are is opened to provide higher pressure hydrogen or working gas to the engine volume 5. Dry hydrogen from the reservoir 59 is heated by the heat exchanger 60 before passing through the sorbent of the trap cell 62. In the trap cell, the hydrogen becomes doped with water vapor as it flows to the engine volume. Thereafter, the control valves 54 and 66 are is closed.

The invention has been described with reference to the preferred and alternate embodiments. Obviously, modifications and alterations will occur to those of ordinary skill in the art upon reading and understanding the preceding detailed description. It is intended that the invention be construed as including all such alterations and modifications insofar as they come within the scope of the appended claims or the equivalents thereof.

Having thus described the preferred embodiments, the invention is now claimed to be:

1. A method of maintaining a selected dopant gas concentration in the working gas of a Stirling engine, the method comprising:

adsorbing the selected dopant on an activated sorbent which has an affinity therefor;

connecting the dopant adsorbed sorbent in gaseous communication with the Stirling engine working gas such that a preselected equilibrium partial pressure is maintained between the dopant and working gases.

2. The method as set forth in claim 1 wherein the working gas is hydrogen and the dopant gas includes an oxide which reacts with surfaces of the Stirling engine to slow the rate of working gas permeation therethrough.

3. The method as set forth in claim 2 in which the sorbent also has an affinity for water vapor and further including the steps of forming water vapor in the Stirling engine by interaction of the hydrogen and dopant gas oxides and adsorbing water vapor on the sorbent to maintain a preselected water vapor concentration in a working volume of the Stirling engine.

4. The method as set forth in claim 1 further including the step of adjusting the temperature of the sorbent to adjust the equilibrium partial pressure hence the dopant concentration.

5. The method as set forth in claim 1 wherein the working gas is hydrogen; the dopant gas is selected from the class consisting essentially of carbon monoxide, carbon dioxide, and water vapor; and the sorbent is selected from the class consisting essentially of a molecular sieve, activated alumina, activated carbon, and activated charcoal.

6. The method as set forth in claim 1 wherein the sorbent is selected from the class consisting essentially of: Aluminosilicates, Silica gel, Acid treated clay, Magnesia-silica gel, Fuller's earth, Diatomaceous earth, Analcite, Brewsterite, Cancrinite, Chabazite, Edingtonite, Epistilibite, Erionite, Faujasite, Gismondite, Gmelinite, Harmotome, Heulanite, Laumonite, Levynite, Metascolecite, Metathomsonite, Mesolite, Mordenite, Natrolite, Phillipsite, Scolecite, Staurite, Stilbite, Thomsonite, Active Alumina, Co-C12 impregnated, Catalytic alumina, Activated bauxite, Chromatographic alumina, Shell-based carbon, Wood based carbon, Coal based carbon, Peat based carbon, Petroleum based carbon, Crosslinked polystyrene, Porous resin, Polystyrene (cross linked), Phenolic Acrylic ester, and Cellulose.

7. The method as set forth in claim 6 wherein the working gas is hydrogen.

8. The method as set forth in claim 7 wherein the dopant gas interacts with surfaces of the Stirling engine to reduce the permeation of hydrogen therethrough.

9. The method as set forth in claim 8 wherein the dopant gas is selected from the class consisting essentially of inorganic and organic gases and vapors which (i) are adsorbed by the adsorbant and (ii) provide at least one of carbon, oxygen, and nitrogen molecules to react with the Stirling engine surfaces.

10. The method as set forth in claim 9 wherein the dopant gas is selected from the class consisting essentially of carbon monoxide, carbon dioxide, and water vapor.

11. In combination, a Stirling engine and a gas cell, the gas cell comprising:

a hermetic enclosure which isolates an interior thereof from the atmosphere;

an activated sorbent disposed in the hermetic enclosure; and, a gas passing means operatively connecting the hermetic enclosure interior and an interior of the Stirling engine such that gas flows therethrough.

12. The combination as set forth in claim 11 wherein a dopant gas is adsorbed on the sorbent such that dopant gas and a working gas of the Stirling engine flow through the gas passing means to establish a partial pressure therebetween.

13. The combination as set forth in claim 12 wherein the gas passing means includes a porous member through which the dopant and working gases diffuse.

14. The combination as set forth in claim 12 wherein the gas passing means includes:

an inlet passage for passing at least the working gas from the Stirling engine to one side of the enclosure; and, an outlet passage for passing the working and dopant gases from another side of the enclosure to the Stirling engine such that the working gas is circulated through the sorbent.

15. The combination as set forth in claim 14 wherein the gas passing means further includes:

a first check valve means for limiting gas flow in the inlet passage from the Stirling engine to the enclosure; and, a second check valve means for limiting gas flow in the outlet passage from the enclosure to the engine.

16. The combination as set forth in claim 14 wherein the gas passing means further includes:

a first flow restrictor for limiting gas flow into the inlet passage from the Stirling engine; and, a second flow restrictor for restricting the flow of gas in the outlet passage from the enclosure to the engine.

17. The combination as set forth in claim 14 wherein the gas passing means further includes a mechanical means for increasing gaseous pressure, the mechanical gas pressure increasing means being disposed along one of the inlet and outlet passages to urge the working gas from the Stirling engine through the enclosure.

18. The combination as set forth in claim 12 wherein the enclosure includes at least one aperture for sealing interconnection with the gas passing means and an automatic closure means for sealing the aperture when the enclosure is separated from the gas passing means.

19. The combination as set forth in claim 18 wherein the automatic closure means includes a collapsible element which expands to close the aperture at atmospheric pressures and which collapses to allow gas to flow therepast at the operating temperatures and pressures of the Stirling engine.

20. A Stirling engine assembly which defines a working gas volume therein, the Stirling engine assembly comprising:

a working gas reservoir for storing a working gas at a pressure greater than pressure of the working gas in the working volume of the Stirling engine;

a trap cell operatively connected between an outlet of the reservoir and the Stirling engine working volume, the trap cell including an enclosure having porous windows at either end thereof and a sorbent with an affinity for water vapor therein, such that water vapor adsorbed on the sorbent diffuses into the hydrogen passing from the reservoir into the working engine;

a compressor means for drawing working gas from the Stirling engine working volume, through the trap cell and pumping the working gas into the hydrogen reservoir, the sorbent in the trap cell at the reduced pressure caused by the compressor adsorbs water vapor from the working gas such that substantially dry working gas is pumped by the compressor into the reservoir, whereby the working gas is doped with water vapor by the tank cell as it passes into the Stirling engine and is dried by the trap cell as it is removed from the working engine for storage in the reservoir to prevent condensation of water vapor in the reservoir.

* * * * *